US007711291B2

(12) United States Patent
Otani

(10) Patent No.: US 7,711,291 B2
(45) Date of Patent: May 4, 2010

(54) DEVELOPING DEVICE WITH DEVELOPER GUIDE MEMBER AND IMAGE FORMING APPARATUS

(75) Inventor: Shinichi Otani, Tokyo (JP)

(73) Assignee: Oki Data Corporation, Tokyo (JP)

( * ) Notice: Subject to any disclaimer, the term of this patent is extended or adjusted under 35 U.S.C. 154(b) by 787 days.

(21) Appl. No.: 11/516,654

(22) Filed: Sep. 7, 2006

(65) Prior Publication Data

US 2007/0077096 A1 Apr. 5, 2007

(30) Foreign Application Priority Data

Sep. 30, 2005 (JP) ..... 2005-289080

(51) Int. Cl.
*G03G 15/08* (2006.01)

(52) U.S. Cl. ..... 399/258; 399/359

(58) Field of Classification Search ..... 399/258–263, 399/359

See application file for complete search history.

(56) References Cited

FOREIGN PATENT DOCUMENTS

JP 02064586 A * 3/1990
JP 2005-017478 1/2005

* cited by examiner

*Primary Examiner*—David M Gray
*Assistant Examiner*—Ruth N Labombard
(74) *Attorney, Agent, or Firm*—Kubotera & Associates, LLC

(57) ABSTRACT

A developing device includes a developer container having a developer supply opening and a developer storage section, so that developer is supplied from the developer container to the developer storage section through the developer supply opening. The developing device further includes a developer guide member disposed below the developer supply opening along a longitudinal direction of the developing device, and a developer delivery member disposed in the developer guide member for delivering developer supplied through the developer supply opening in a longitudinal direction of the developer guide member. The developer guide member has a wall portion having a shape so that developer flows out the developer guide member in a substantially uniform amount along the longitudinal direction of the developing device.

18 Claims, 12 Drawing Sheets

DEVELOPING DEVICE WITH DEVELOPER GUIDE MEMBER AND IMAGE FORMING APPARATUS

BACKGROUND OF THE INVENTION AND RELATED ART STATEMENT

The present invention relates to a developing device and an image forming apparatus.

In a conventional image forming apparatus such as a printer, a copier, and a facsimile, an image is formed through the following process. First, a charge roller charges a surface of a photosensitive drum. An exposure device such as an LED head exposes the surface of the photosensitive drum to form a static latent image or a latent image thereon. A developing roller attaches a thin layer of toner to the static latent image to form a toner image. A transfer roller transfers the toner image to a sheet or a recording medium, thereby forming an image or printing on the recording medium. A developing device is formed of the photosensitive drum, the charge roller, the developing roller, and so on.

After transferring the toner image, the sheet is transported to a fixing device, so that the fixing device fixes the toner image to the sheet.

In the conventional image forming apparatus described above, the developing device is provided with a developing device main body and a toner cartridge detachably attached to the developing device main body. The toner cartridge supplies toner to the developing device main body through a toner supply opening thereof. When the toner cartridge is removed from the developing device main body, toner sticking to a surrounding area of the toner supply opening may drop, thereby making inside the image forming apparatus dirty. To this end, the toner supply opening tends to have a small opening and be formed at a center portion of each of the toner cartridge and the developing device main body.

As described above, in the conventional developing device, the toner supply opening is formed at a center portion of each of the toner cartridge and the developing device main body. Accordingly, toner tends to drop only at a specific location inside the developing device. Especially, in the developing device before being used or after toner is detected to be a low level, when the toner cartridge is attached to the developing device main body and supplies toner, a large amount of toner is supplied at a center portion of the developing device main body, and a small amount of toner is supplied at both side portions thereof. Accordingly, it is difficult to uniformly supply toner along a longitudinal direction of the developing device, that is, a width direction of the image forming apparatus. As a result, a resultant image tends to have a difference in darkness in a width direction of a sheet, thereby deteriorating image quality.

In view of the problems described above, an object of the present invention is to provide a developing device and an image forming apparatus, in which it is possible to solve the problems in the conventional developing device. In particular, it is possible to prevent an image from having a difference in darkness in a width direction of a recording medium, and to improve image quality.

Further objects and advantages of the invention will be apparent from the following description of the invention.

SUMMARY OF THE INVENTION

In order to attain the objects described above, according to the present invention, a developing device includes a developer container having a developer supply opening and a developer storage section, so that developer is supplied from the developer container to the developer storage section through the developer supply opening. The developing device further includes a developer guide member disposed below the developer supply opening along a longitudinal direction of the developing device, and a developer delivery member disposed in the developer guide member for delivering developer supplied through the developer supply opening in a longitudinal direction of the developer guide member. The developer guide member has a wall portion having a shape so that developer flows out the developer guide member in a substantially uniform amount along the longitudinal direction of the developing device.

As described above, in the present invention, the developing device includes the developer container having the developer supply opening and the developer storage section, so that developer is supplied from the developer container to the developer storage section through the developer supply opening. The developing device further includes the developer guide member disposed below the developer supply opening along the longitudinal direction of the developing device, and the developer delivery member disposed in the developer guide member for delivering developer supplied through the developer supply opening in the longitudinal direction of the developer guide member. The developer guide member has the wall portion having a shape so that developer flows out the developer guide member in a substantially uniform amount along the longitudinal direction of the developing device.

With the configuration described above, it is possible to prevent an image from having a difference in darkness in a width direction of a recording medium, and to improve image quality.

DETAILED DESCRIPTION OF PREFERRED EMBODIMENTS

Hereunder, embodiments of the present invention will be explained with reference to the accompanying drawings. In the embodiments, a color printer will be explained as an image forming apparatus for forming an image.

First Embodiment

Figure 2:
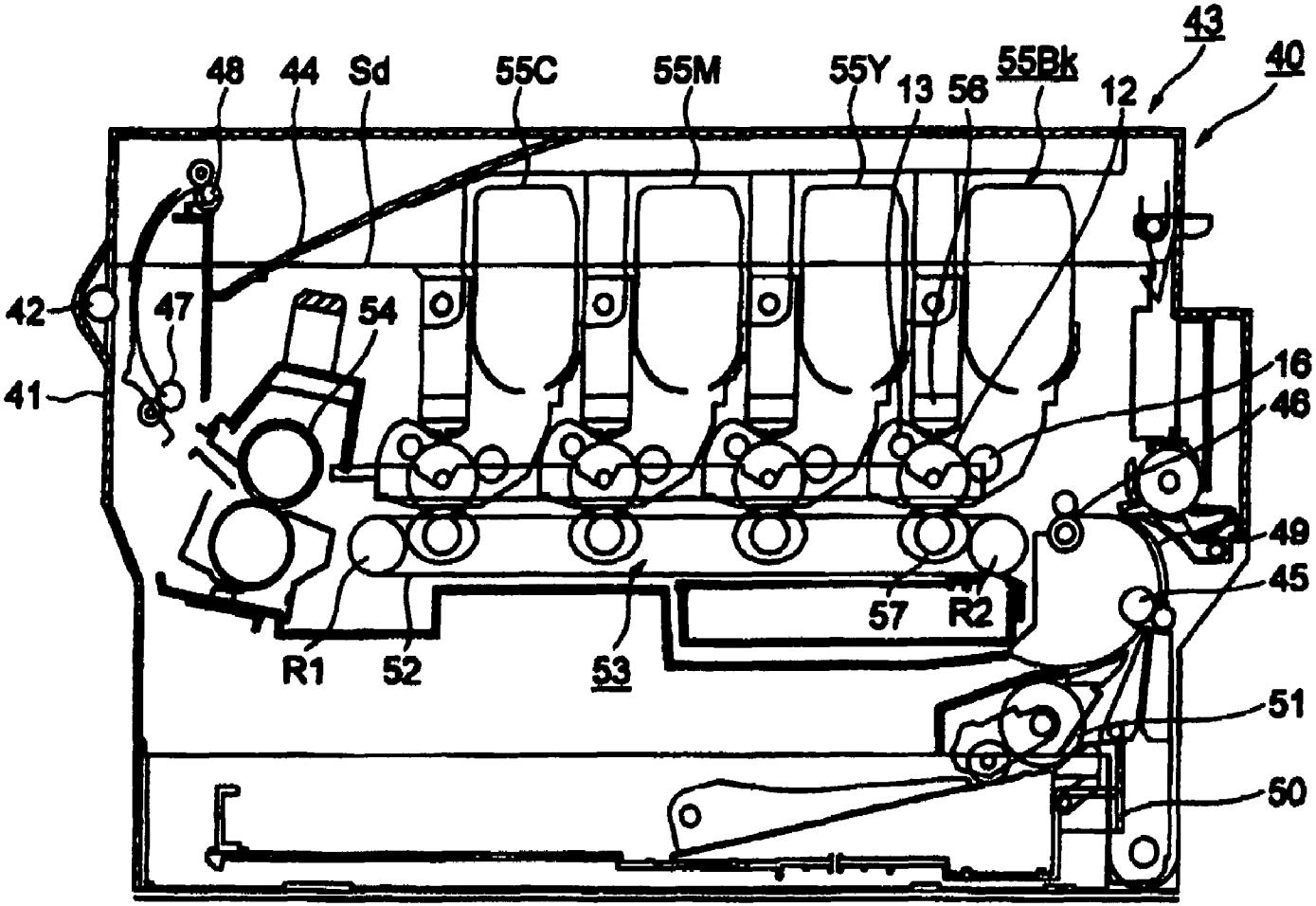
FIG. 2 is a schematic view showing a printer according to the first embodiment of the present invention.

FIG. 2 is a schematic view showing a printer 40 according to a first embodiment of the present invention. As shown in FIG. 2, the printer 40 includes a lower cover or lower housing 41, and an upper cover or upper housing 43 disposed to be rotatable around a supporting shaft 42 relative to the lower cover 41 for freely opening and closing the printer 40. A stacker 44 is disposed in the upper cover 43 for receiving a sheet or recording medium after printing. In FIG. 2, a line Sd represents a boundary between the lower cover 41 and the upper cover 43.

A sheet supply cassette 50 is disposed at a lower portion inside the lower cover 41 as a medium storage unit for storing a sheet. A supply roller or medium supply member 51 is disposed at a front end of the sheet supply cassette 50 for supplying a sheet to a sheet transport path 49. The sheet transport path 49 has an S character shape, and is provided with sheet supply rollers 45 to 47 and a belt unit or sheet transport member 53. The belt unit 53 includes a drive roller or first roller R1; a follower roller or second roller R2; and a transport belt or transport member 52 placed between the drive roller R1 and the follower roller R2.

In the belt unit 53, the transport belt 52 moves to transport a sheet, so that the sheet passes through between transfer rollers or transfer devices 57 and a plurality of developing devices or image forming units (image drum units) 55Bk, 55Y, 55M, and 55C for forming images in colors such as black, yellow, magenta, and cyan.

Each of the developing devices 55Bk, 55Y, 55M, and 55C includes a photosensitive drum or image supporting member 12; a charge roller or charge device 13 disposed around the photosensitive drum 12; and a developing roller or developer supporting member 16 for holding developer or toner. Recording heads or exposure devices 56 are disposed adjacent to the developing devices 55Bk, 55Y, 55M, and 55C, respectively. The transfer rollers 57 are disposed to face the developing devices 55Bk, 55Y, 55M, and 55C with the transport belt 52 in between.

In the developing devices 55Bk, 55Y, 55M, and 55C, the photosensitive drums 12 are driven with drum motors or drive devices (not shown) to rotate in a specific direction for forming an image. While the photosensitive drums 12 rotate, the charge rollers 13 uniformly charge surfaces of the photosensitive drums 12. The recording heads 56 expose the surfaces of the photosensitive drums 12 to form latent images thereon. Toner on the developing rollers 16 is electrostatically attached to the latent images to form toner images or developer images.

After a sheet is supplied to the sheet transport path 49 and transported with the sheet supply rollers 45 and 46, the sheet passes through between the transfer rollers 57 and the developing devices 55Bk, 55Y, 55M, and 55C. Each of the transfer rollers 57 sequentially transfers the toner image or the developer image in each color formed at each of the developing devices 55Bk, 55Y, 55M, and 55C to the sheet, thereby forming the toner image in colors.

Afterward, the sheet is transported to a fixing unit or fixing device 54 for fixing the toner image in colors to the sheet, thereby forming a color image. After discharged from the fixing unit 54, the sheet is transported with the sheet supply roller 47 and discharged with a discharge roller 48 to the stacker 44.

A configuration of the developing devices 55Bk, 55Y, 55M, and 55C will be explained next. Since the developing devices 55Bk, 55Y, 55M, and 55C have an identical configuration, only the developing device 55Bk will be explained in detail.

Figure 1:
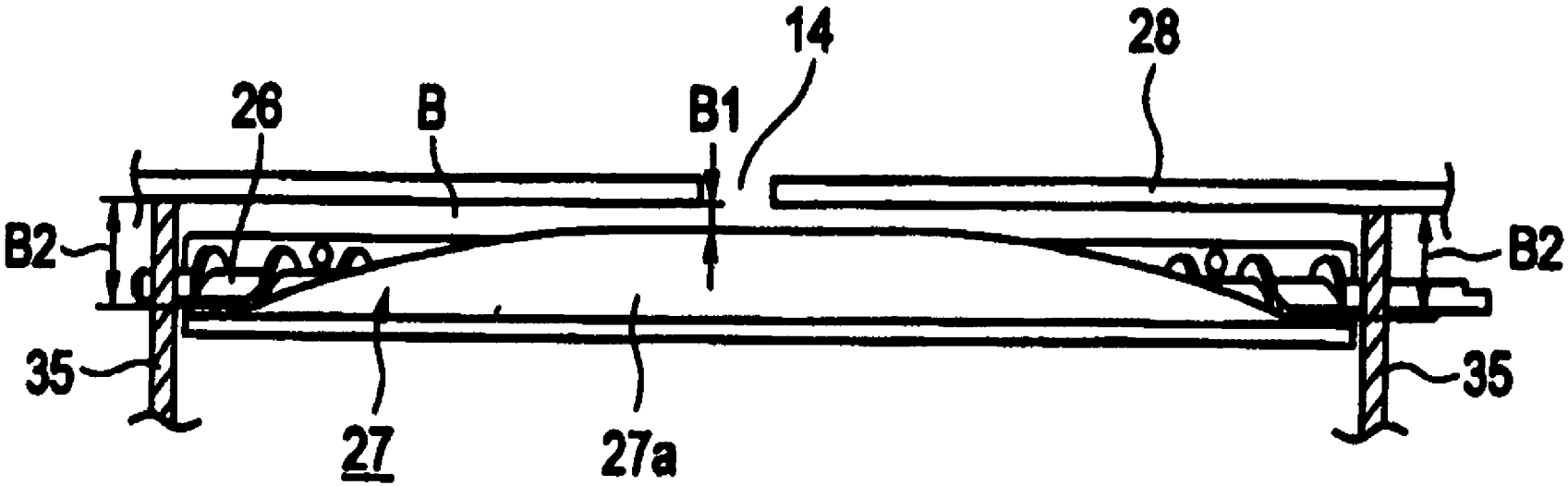
FIG. 1 is a schematic sectional view showing a main portion of developing device according to a first embodiment of the present invention.
Figure 3:
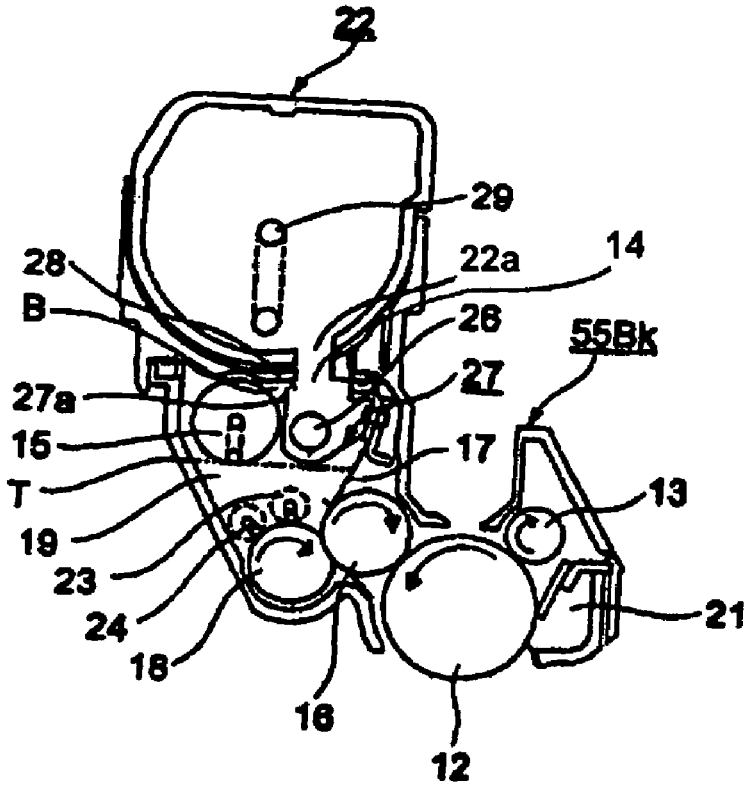
FIG. 3 is a schematic sectional view of the developing device according to the first embodiment of the present invention.
Figure 4:
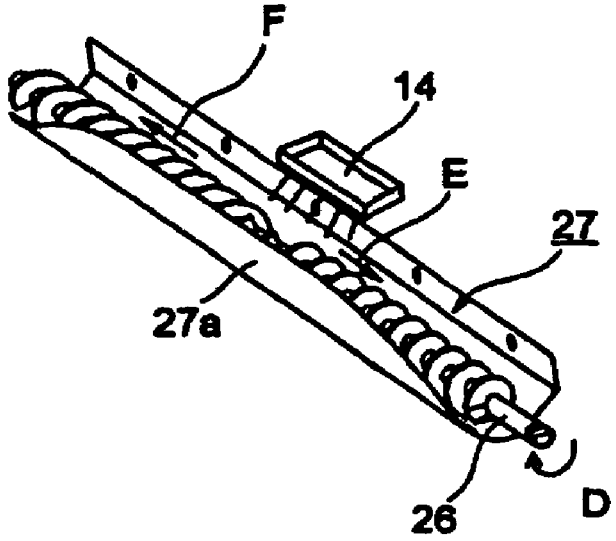
FIG. 4 is a schematic perspective view showing a main portion of the developing device according to the first embodiment of the present invention.
Figure 5:
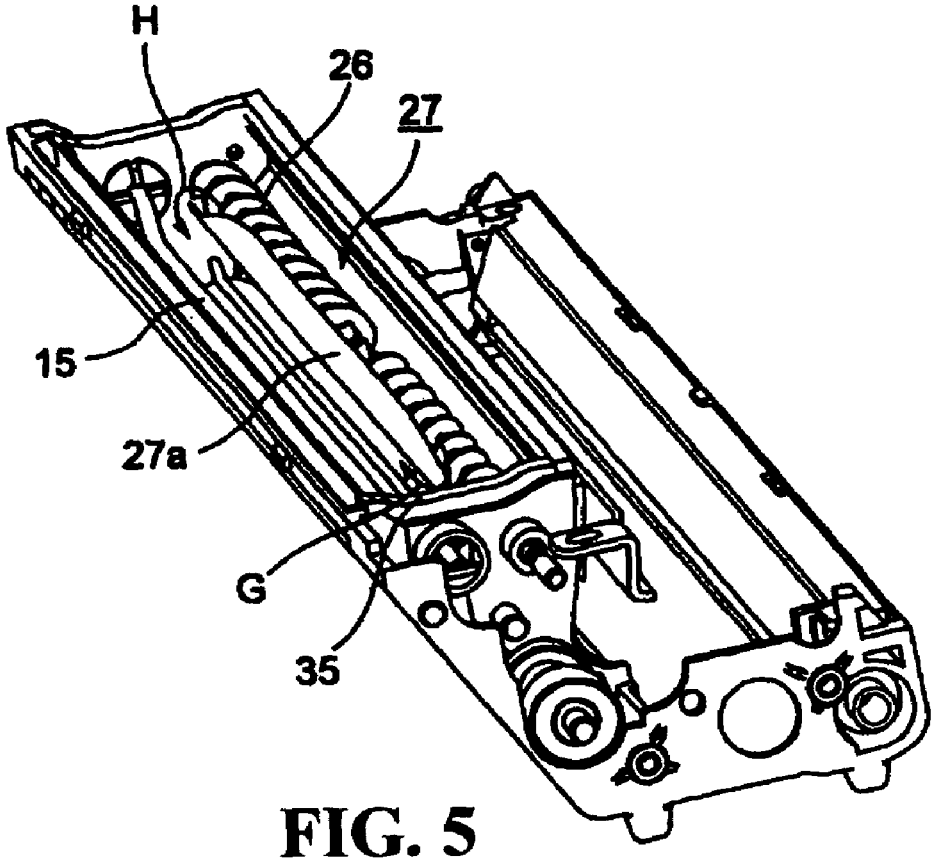
FIG. 5 is a schematic perspective view showing the developing device according to the first embodiment of the present invention.

FIG. 1 is a schematic sectional view showing a main portion of the developing device according to the first embodiment of the present invention. FIG. 3 is a schematic sectional view of the developing device according to the first embodiment of the present invention. FIG. 4 is a schematic perspective view showing a main portion of the developing device according to the first embodiment of the present invention. FIG. 5 is a schematic perspective view showing the developing device according to the first embodiment of the present invention.

As shown in FIGS. 1 and 3-5, the developing device 55Bk includes the charge roller 13 for charging the photosensitive drum 12 while rotating in a state that the charge roller 13 contacts with the photosensitive drum 12; the developing roller or developer supporting member 16 for supplying toner to the photosensitive drum 12; a developer blade 17 for controlling an amount of toner on the developing roller 16; a supply roller or developer supply member 18 for supplying toner to the developing roller 16; a developer storage section 19 for storing toner or developer therein; and a cleaning member 21 for removing toner remaining on the photosensitive drum 12.

In the developing device 55Bk, the photosensitive drum 12, the charge roller 13, the developing roller 16, and the supply roller 18 rotate in arrow directions shown in FIG. 3.

A toner cartridge 22 is detachably attached to a main body of the developing device 55Bk, i.e., a developing device main body. In the embodiment, the toner cartridge 22 constitutes a developer container having a toner supply opening 22*a* formed in a bottom portion thereof, so that toner is supplied to the developer storage section 19 through a toner supply opening 14 formed in the developing device 55Bk. The toner supply opening 14 is formed at a center portion of an upper portion 28 of the developing device 55Bk in a longitudinal direction thereof. A stirring bar or first stirring device 29 is disposed inside the toner cartridge 22 for stirring toner to be supplied to the developer storage section 19.

Further, stirring members or second and third stirring devices 23 and 24 are disposed inside the developer storage section 19 for stirring toner inside the developer storage section 19. The stirring members 23 and 24 are arranged adjacent to the supply roller 18 and in parallel with each other. A toner amount detection sensor or developer amount detection unit 15 is disposed inside the developer storage section 19 for detecting an amount of toner inside the developer storage section 19.

Further, a spiral or developer delivery member 26 and a toner guide or developer guide member 27 having a U character shape are provided inside the developer storage section 19 for delivering toner supplied from the toner supply opening 22*a* of the toner cartridge 22 through the toner supply opening 14 of the developing device 55Bk in a width direction of the printer 40, i.e., a longitudinal direction of the developer storage section 19. In the embodiment, the stirring member 23, the stirring member 24, the toner amount detection sensor 15, the spiral 26, and the toner guide 27 are arranged along a longitudinal direction of the developing device 55Bk.

A space B is formed between a wall portion 27*a* of the toner guide 27 and the upper portion 28 of the developing device 55Bk covering the developer storage section 19. As shown in FIG. 1, an upper edge of the wall portion 27*a* is curved. Accordingly, the wall portion 27*a* has a height largest at a center portion of the toner guide 27 close to the toner supply opening 14, and the height is gradually decreasing toward both end sides and becomes about zero at the both ends. As a result, the space B becomes small at the center portion of the toner guide 27, and increases toward the both end sides of the toner guide 27. That is, B1 is smaller than B2, in which B1 is the space B at the center portion and B2 is the space at the both end sides. Seal sponge members or seal members 35 are disposed at the both end sides of the toner guide 27.

As shown in FIG. 3, in the sectional view of the developing device 55Bk, the toner guide 27 is situated at a right side of the developer storage section 19, that is, above a downstream side of the supply roller 18 in a rotational direction thereof (side contacting with the developing roller 16). The space B is situated at an approximately upper center portion of the developer storage section 19.

With the configuration described above, toner dropping from the toner guide 27 accumulates on the left side of the developer storage section 19 from the center portion thereof in FIG. 3, that is, the upstream side of the supply roller 18 in the rotational direction thereof. In other words, toner does not accumulate on the downstream side of the supply roller 18 in a rotational direction thereof. Accordingly, toner newly supplied from the toner cartridge 22 is not supplied toward the downstream side of the supply roller 18 (close to a contact point between the supply roller 18 and the developing roller 16), thereby not being consumed predominantly. Old toner (toner existing in the developer storage section 19 before) does not tend to remain in the developer storage section 19 for a long time, and is sequentially consumed. Accordingly, it is possible to prevent toner from staying in the developing device 55Bk for a long time without being consumed.

In FIG. 3, a position T represents a position of an upper surface of toner inside the developer storage section 19, i.e., a toner position or developer position, when a level of toner is detected to be low just before the toner cartridge 22 is replaced. When toner is located at the toner position T, it is necessary to supply toner. When the toner amount detection sensor 15 detects a state that toner does not exist in the developer storage section 19, or a toner low (toner end) or developer low, the toner cartridge 22 is replaced.

When the toner cartridge 22 is replaced and the developing device 55Bk is used, toner is supplied to the developer storage section 19 from the toner supply opening 22*a* of the toner cartridge 22 through the toner supply opening 14 of the developing device 55Bk with the stirring bar 29 disposed inside the toner cartridge 22 as the rotatable stirring member, so that toner is accommodated in the toner guide 27.

As shown in FIG. 4, the spiral 26 has a thread on one side from a center to one end opposite to that on the other side from the center to the other end. Accordingly, when the spiral 26 rotates in an arrow direction D, toner is divided inside the toner guide 27 in opposite arrow directions E and F.

As described above, the wall portion 27*a* of the toner guide 27 has a height largest at the center portion of the toner guide 27 close to the toner supply opening 14, and the height is decreasing gradually toward the both end sides. As a result, the space B becomes small at the center portion of the toner guide 27, and increases toward the both end sides of the toner guide 27. Accordingly, tone accumulated in the toner guide 27 is divided and delivered in the opposite arrow directions E and F, and flows outside the toner guide 27 through the space B.

When the developer storage section 19 is filled with toner, toner inside the toner cartridge 22 is no longer supplied. When the developing device 55Bk performs a series of image forming processes, the stirring bar 29 and the spiral 26 continue to rotate. As a result, toner reaching at the both end sides of the toner guide 27 is circulated in arrow directions G and H through the rotation of the spiral 26 at an upper layer of toner inside the developer storage section 19.

Figure 6:
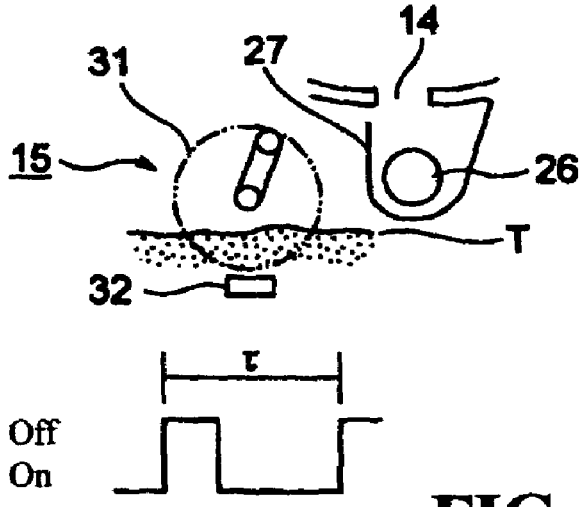
FIG. 6 is a schematic view (No. 1) showing an operation of a toner amount detection sensor according to the first embodiment of the present invention.
Figure 7:
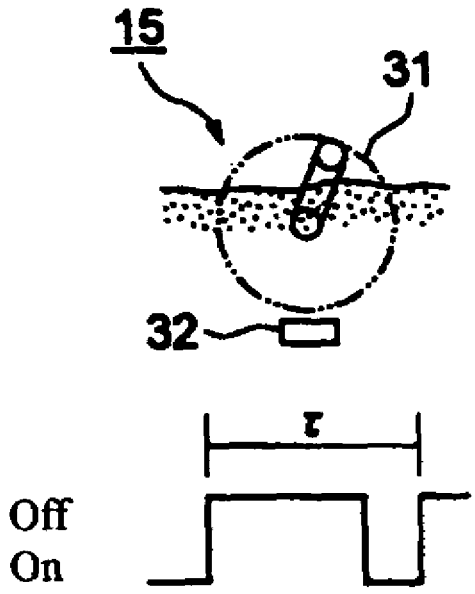
FIG. 7 is a schematic view (No. 2) showing an operation of a toner amount detection sensor according to the first embodiment of the present invention.

An operation of the toner amount detection sensor 15 will be explained next. FIG. 6 is a schematic view (No. 1) showing the operation of the toner amount detection sensor according to the first embodiment of the present invention. FIG. 7 is a schematic view (No. 2) showing the operation of the toner amount detection sensor according to the first embodiment of the present invention.

As shown in FIGS. 6 and 7, the toner amount detection sensor 15 is provided with a stirring member 31 and a sensor 32. The stirring member 31 is rotated at a cycle $\tau$ for stirring toner, thereby preventing toner inside the developer storage section 19 from being agglomerated. The stirring member 31 is rotated inside the developer storage section 19 from a lowermost point to an uppermost point with a regulating member (not shown) pushing the stirring member 31, and rotates with own weight from the uppermost point to the lowermost point. According to an amount of toner inside the developer storage section 19, it is controlled to change a period of an off time during which the stirring member 31 reaches the lowermost point from the uppermost point, that is, the sensor 32 detects the stirring member 31 to turn on.

As shown in FIG. 6, when an amount of toner at a low level, the period of the off time becomes short. On the other hand, as shown in FIG. 7, when an amount of toner at a full level, i.e., toner full or developer full, the period of the off time becomes long.

A sensor signal of the sensor 32 is sent to a control unit (not shown), so that a developer amount detection processing unit of the control unit performs a developer amount detection process. In the developer amount detection process, first, the developer amount detection processing unit detects the toner low according to the sensor signal. Upon detecting the toner low, the developer amount detection processing unit performs a display process, so that a message prompting replacement of the toner cartridge 22 is displayed on a display unit (not shown). Further, an image forming operation processing unit of the control unit performs an image forming operation process, thereby completing an image forming process or printing process.

As shown in FIG. 6, when an amount of toner at a low level, the toner position T is situated below the toner guide 27 and the spiral 26.

When the developing device 55Bk is used for the first time or the toner low is detected just before the toner cartridge 22 is replaced, toner is supplied to the developer storage section 19 and accumulated inside the developer storage section 19 in a state explained below.

Figure 8:
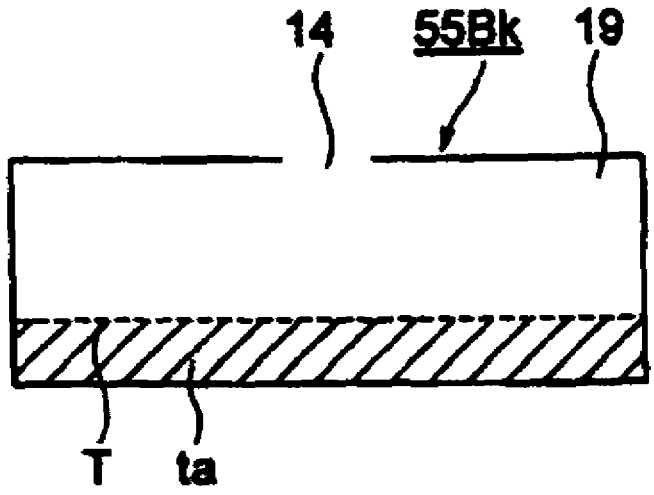
FIG. 8 is a schematic view showing a developer container without a toner guide in a state that a level of toner is low according to the first embodiment of the present invention.
Figure 9:
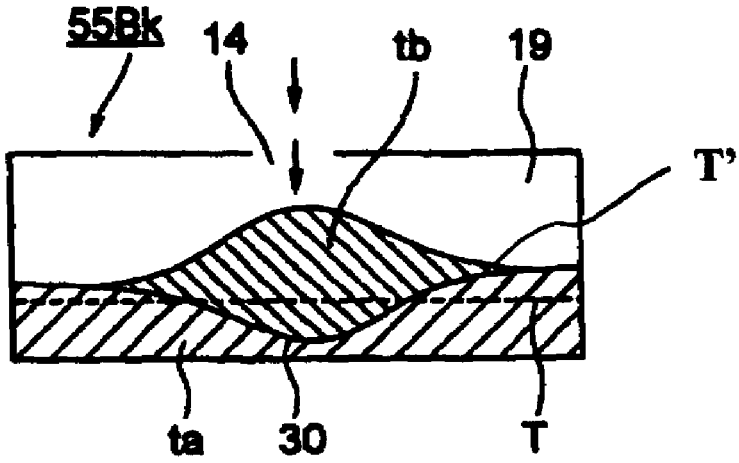
FIG. 9 is a schematic view showing the developer container without the toner guide in a state that toner is supplied therein according to the first embodiment of the present invention.
Figure 10:
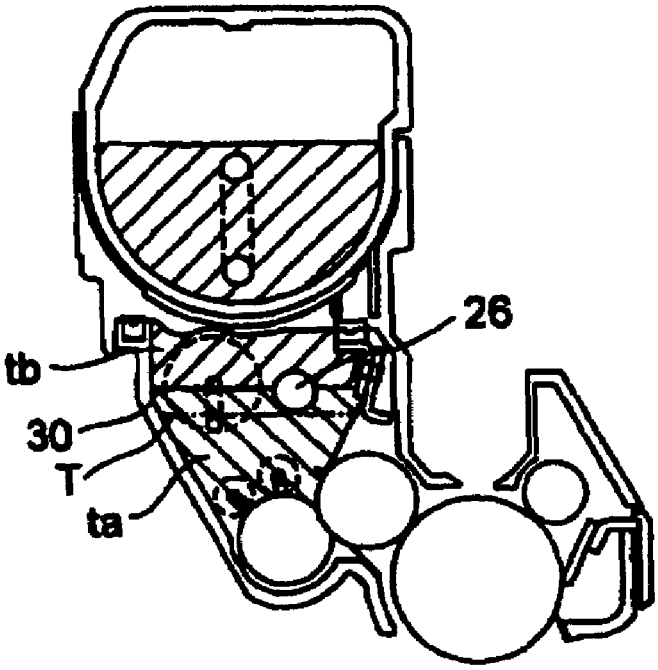
FIG. 10 is a schematic view showing the developer container without the toner guide in a state that a level of toner is full at a side portion of the developer container according to the second embodiment of the present invention.
Figure 11:
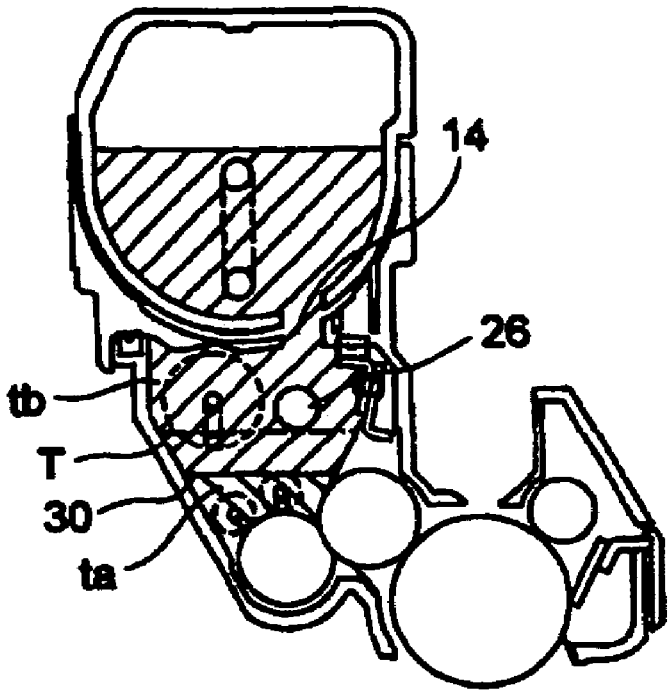
FIG. 11 is a schematic view showing the developer container without the toner guide in a state that a level of toner is full at a center portion of the developer container according to the second embodiment of the present invention.
Figure 12:
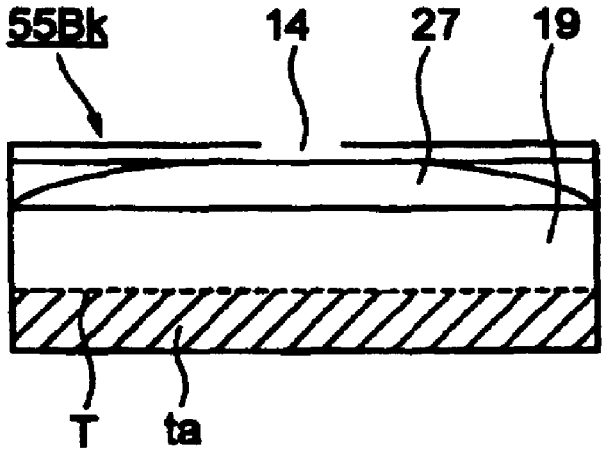
FIG. 12 is a schematic view showing the developer container with the toner guide in a state that a level of toner is low according to the first embodiment of the present invention.
Figure 13:
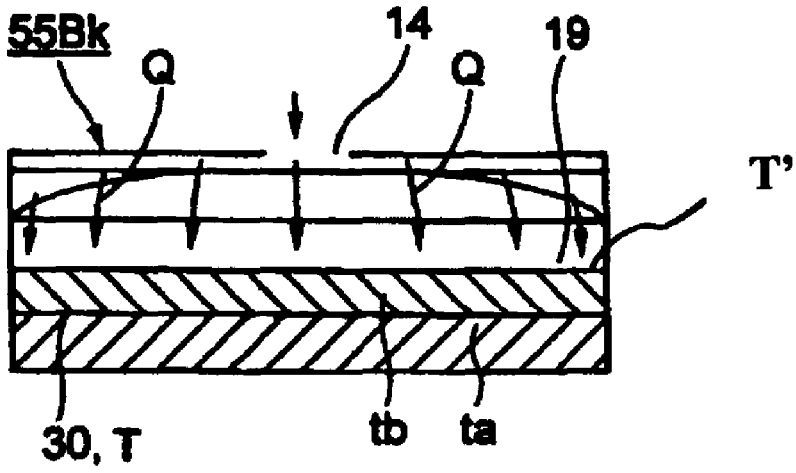
FIG. 13 is a schematic view showing the developer container with the toner guide in a state that toner is supplied therein according to the first embodiment of the present invention.
Figure 14:
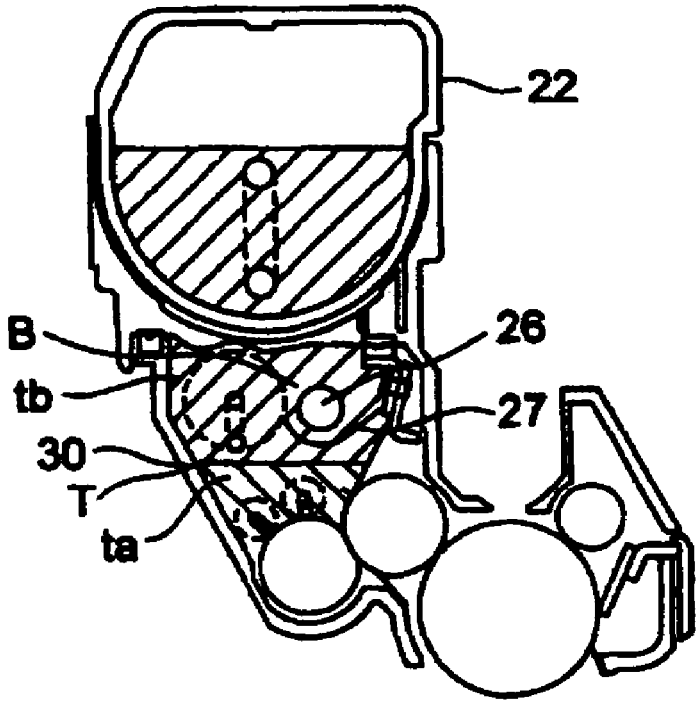
FIG. 14 is a schematic view showing the developer container with the toner guide in a state that a level of toner is full at the side portion of the developer container according to the first embodiment of the present invention.
Figure 15:
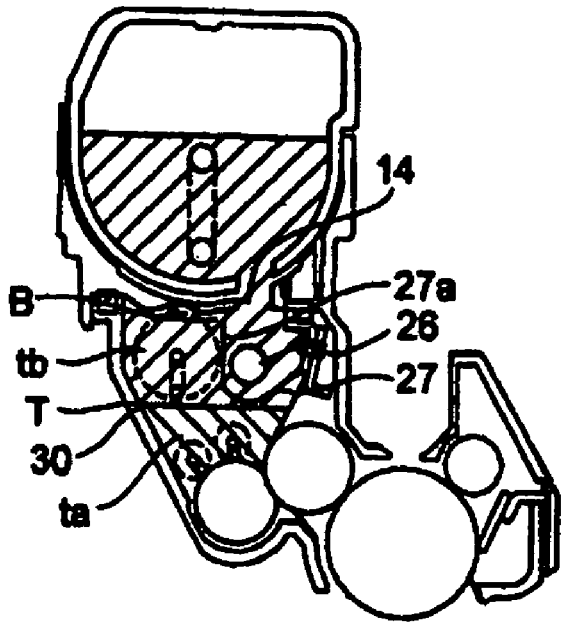
FIG. 15 is a schematic view showing the developer container with the toner guide in a state that a level of toner is full at the center portion of the developer container according to the first embodiment of the present invention.
Figure 16:
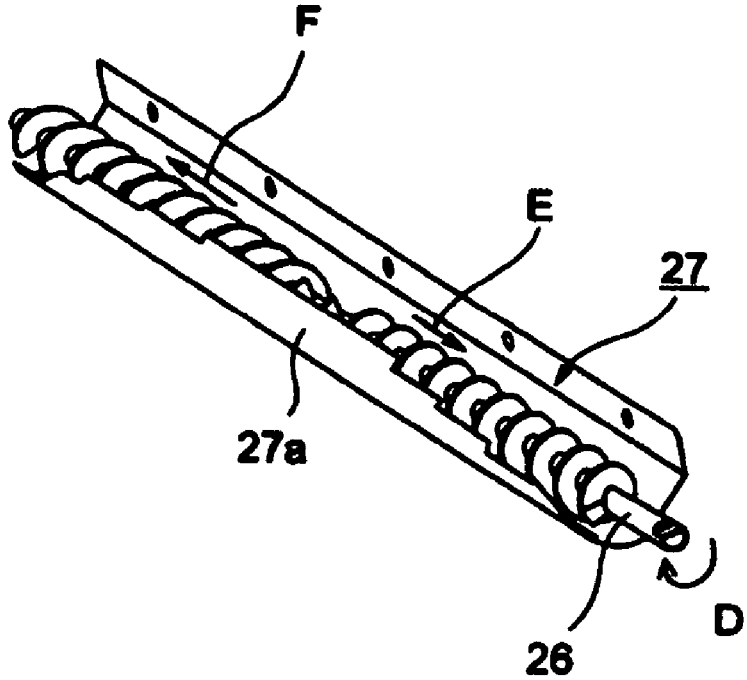
FIG. 16 is a schematic perspective view showing a main portion of the developing device according to the first embodiment of the present invention.

FIG. 8 is a schematic view showing the developer container without the toner guide in a state that a level of toner is low. FIG. 9 is a schematic view showing the developer container without the toner guide in a state that toner is supplied therein. FIG. 10 is a schematic view showing the developer container without the toner guide in a state that a level of toner is full at a side portion of the developer container. FIG. 11 is a schematic view showing the developer container without the toner guide in a state that a level of toner is full at a center portion of the developer container. FIG. 12 is a schematic view showing the developer container with the toner guide in a state that a level of toner is low according to the first embodiment of the present invention. FIG. 13 is a schematic view showing the developer container with the toner guide in a state that toner is supplied therein according to the first embodiment of the present invention. FIG. 14 is a schematic view showing the developer container without the toner guide in a state that a level of toner is full at the side portion of the developer container according to the first embodiment of the present invention. FIG. 15 is a schematic view showing the developer container with the toner guide in a state that a level of toner is full at the center portion of the developer container according to the first embodiment of the present invention. FIG. 16 is a schematic perspective view showing a main portion of the developing device according to the first embodiment of the present invention.

In FIGS. 8-16, ta represents toner contained in the developer storage section 19 at a low level (toner low); tb represents toner supplied from the toner cartridge 22; and 30 represents a boundary between ta and tb.

In a case that the toner guide 27 is not provided, when the toner tb is supplied into the developer storage section 19 through the toner supply opening 14 disposed at the center portion in the longitudinal direction, the toner tb is accumulated locally on the toner tb right below the toner supply opening 14 as shown in FIG. 9. As a result, a toner accumulated surface T' becomes high at a position just below the toner supply opening 14 to form a top of a mountain shape, and is declining away from the top of the mountain shape. Accordingly, the toner tb locally accumulated pushes the toner ta toward the both side portions, so that the toner ta forms a valley shape with a bottom situated just below the toner supply opening 14 and ascending away from the bottom.

In the state described above, when toner is supplied continuously and filled within the developer storage section 19, toner is accumulated at the both side portions of the developer storage section 19 in a state shown in FIG. 10, and at the center portion of the developer storage section 19 in a state shown in FIG. 11. That is, the boundary 30 is situated above the toner position T at the both side portions, and is situated below the toner position T at the center portion.

In this case, a weight of the toner tb is applied to a center portion of the toner ta, and is not applied to both side portions of the toner ta. As a result, the center portion of the toner ta is compressed as opposed to the both side portions thereof, thereby making it difficult to deliver the center portion of the toner ta to the developing roller 16 with the supply roller 18. When the toner ta is used for printing, a resultant image tends to have a difference in darkness along a width direction of a sheet, thereby deteriorating image quality.

On the other hand, in a case that the toner guide 27 is provided, when toner is supplied through the toner supply opening 14, toner is temporarily accumulated in the toner guide 27. Then, toner is delivered toward the both end sides of the toner guide 27 with the spiral 26. As described above, the space B is small at the center portion of the toner guide 27, and enlarges toward the both end sides of the toner guide 27. Accordingly, a part of toner moves over the wall portion 27*a*, and flows out of the toner guide 27 through the space B. A remaining part of toner is delivered toward the both end sides with the spiral 26.

While being delivered, toner flows out of the toner guide 27 through the space B. Accordingly, an amount of toner decreases as toner is delivered closer to the both end sides of the toner guide 27. As described above, the space B enlarges toward the both end sides of the toner guide 27, thereby making it easy for toner to flow out of the toner guide 27. As a result, as shown in FIG. 13, an amount of toner flowing out of the toner guide 27 through the space B in an arrow direction G becomes uniform along the longitudinal direction of the developer storage section 19. That is, the toner accumulated surface T' becomes flat along the longitudinal direction of the developer storage section 19.

When toner is supplied continuously and filled within the developer storage section 19, toner is accumulated at the both side portions of the developer storage section 19 in a state shown in FIG. 14, and at the center portion of the developer storage section 19 in a state shown in FIG. 15. That is, the boundary 30 is situated at a level same as that of the toner position T at the both side portions and the center portion.

In this case, the weight of the toner tb is uniformly applied to both the center portion and the both side portions of the toner ta. As a result, it is possible to stably deliver both the center portion and the both side portions of the toner ta. When the toner ta is used for printing, it is possible to prevent a resultant image from having a difference in darkness along a width direction of a sheet, thereby improving image quality.

After the developer storage section 19 is filled with toner, toner is consumed for printing. Until all of toner inside the toner cartridge 22 is consumed and the toner amount detection sensor 15 detects the toner low, an amount of toner flowing out of the toner guide 27 is maintained at a constant level along the longitudinal direction of the developer storage section 19. Further, as shown in FIG. 5, toner is circulated in the arrow directions G and H, thereby maintaining image quality.

In the embodiment, an amount of toner inside the toner cartridge 22 is, for example, 60 g. When the developing device 55Bk is filled with toner, an amount of toner inside the developing device 55Bk is, for example, 50 g. An amount of toner inside the developer storage section 19 just before the toner cartridge 22 is replaced is, for example, 30 g. A length of the developer storage section 19 in the longitudinal direction thereof is, for example, about 230 mm.

When toner is supplied from the toner cartridge 22 and an amount of toner inside the developer storage section 19 reaches 50 g, the stirring bar 29 inside the toner cartridge 22 no longer delivers toner. Accordingly, unless toner is consumed for printing, toner is not supplied to the developer storage section 19. Just after the toner cartridge 22 is replaced, toner is supplied in an amount of 20 g. An amount of toner per unit length along the longitudinal direction is 0.09 g/mm until the developer storage section 19 is filled with toner. The supplied amount of toner per unit length along the longitudinal direction 0.09 g/mm is determined by an amount of toner delivered with the spiral 26 and a size of the space B associated with the shape of the toner guide 27.

In the embodiment, through adjusting a size of the space B, it is possible to uniformly accumulate toner inside the developer storage section 19 along the longitudinal direction thereof with the spiral 26 rotating at a constant rotational speed without controlling an amount of toner supplied from the toner cartridge 22 or the rotational speed of the spiral 26, or rotating and stopping the spiral 26. Accordingly, it is possible to prevent an image from having a difference in darkness along a width direction of a sheet, thereby improving image quality.

Further, it is not necessary to control an amount of toner supplied from the toner cartridge 22, or an amount of toner delivered with the spiral 26, thereby reducing cost of the printer 40. In the embodiment, the upper edge of the wall portion is curved, and may have a step shape connected with straight lines as shown in FIG. 16.

Second Embodiment

A second embodiment of the present invention will be explained next. Components similar to those in the first embodiment are designated with the same reference numerals, and explanations thereof are omitted. The components similar to those in the first embodiment provide the similar effects.

Figure 17:
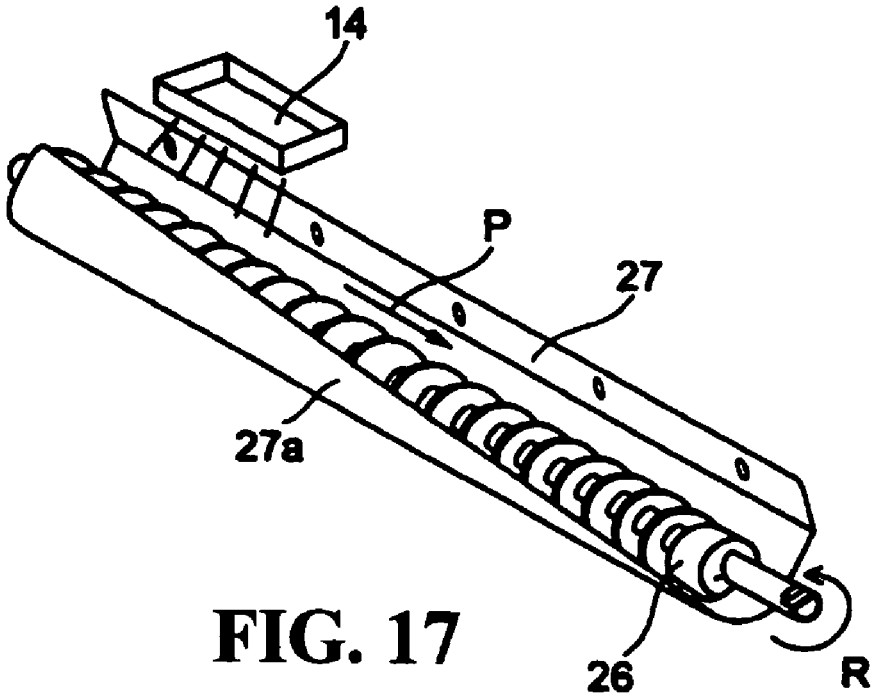
FIG. 17 is a schematic perspective view showing a main portion of the developing device according to a second embodiment of the present invention.

FIG. 17 is a schematic perspective view showing a main portion of the developing device according to the second embodiment of the present invention. As shown in FIG. 17, the toner supply opening 14 is formed at one end side of the developer storage section 19 in the longitudinal direction thereof. Accordingly, an upper edge of the wall portion 27*a* of the toner guide 27 has a height largest at one end side of the toner guide 27 adjacent to the toner supply opening 14, and is decreasing toward the other end side.

Further, the spiral 26 has a thread circling in a same direction over a whole axial direction. Accordingly, when the spiral 26 rotates in an arrow direction R, toner is delivered inside the toner guide 27 from the one end side to the other end side in an arrow direction P.

Third Embodiment

Figure 18:
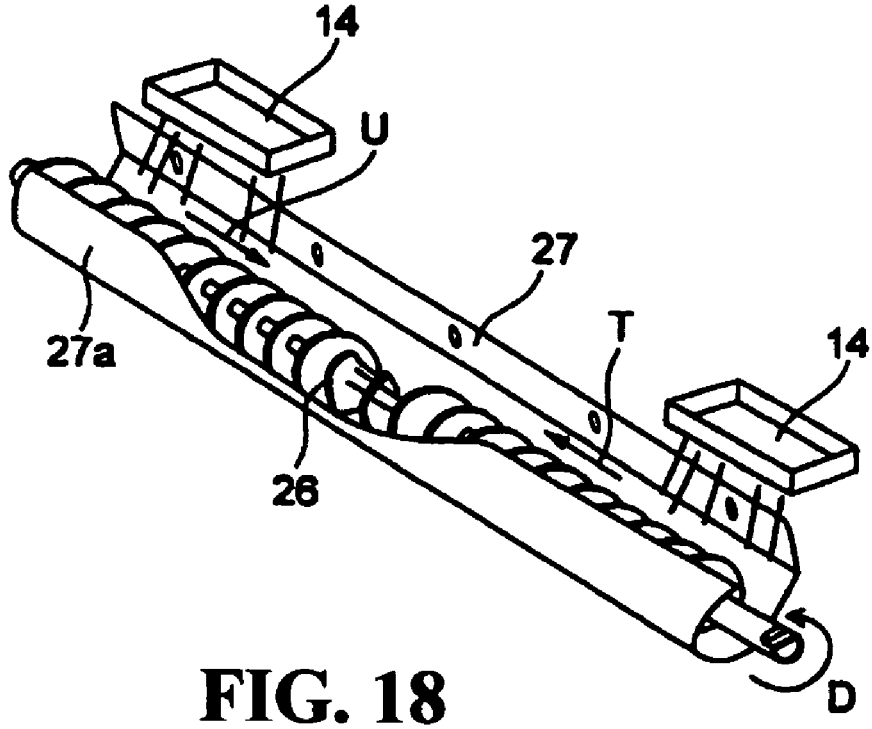
FIG. 18 is a schematic perspective view showing a main portion of the developing device according to a third embodiment of the present invention.

A third embodiment of the present invention will be explained next. FIG. 18 is a schematic perspective view showing a main portion of the developing device according to the third embodiment of the present invention.

As shown in FIG. 18, the toner supply openings 14 are formed at both end sides of the developer storage section 19 in the longitudinal direction thereof. Accordingly, an upper edge of the wall portion 27*a* of the toner guide 27 has a height smallest at the center portion of the toner guide 27, and is decreasing toward the both end sides thereof.

The spiral 26 has a thread on one side from a center to one end opposite to that on the other side from the center to the other end, and the thread circles in a direction opposite to that in the first embodiment. Accordingly, when the spiral 26 rotates in an arrow direction D, toner is delivered inside the toner guide 27 in opposite arrow directions U and T.

Fourth Embodiment

Figure 19:
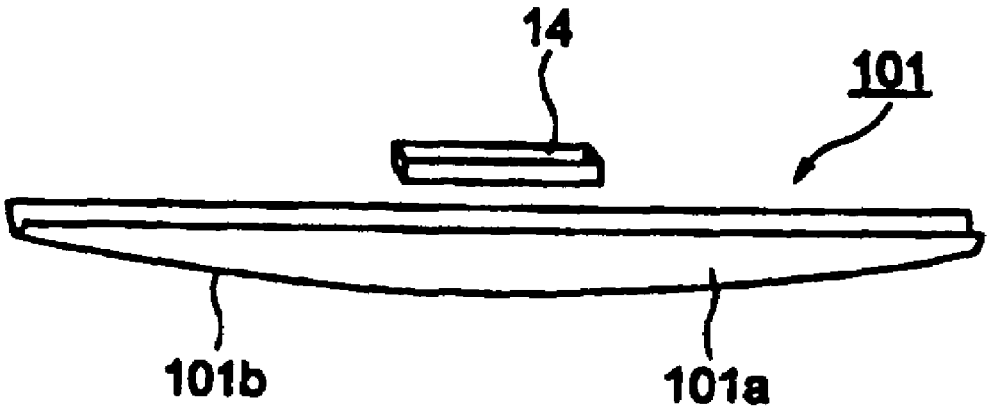
FIG. 19 is a schematic perspective view showing a toner guide according to a fourth embodiment of the present invention.

A fourth embodiment of the present invention will be explained next. FIG. 19 is schematic perspective view showing a toner guide 101 according to the fourth embodiment of the present invention.

As shown in FIG. 19, the toner guide 101 includes a bottom portion 101*b* having a depth largest adjacent to the toner supply opening 14 (center portion) and decreasing away from the toner supply opening 14 (toward both end sides), and a wall portion 101*a* having a length in a vertical direction largest adjacent to the toner supply opening 14 and decreasing toward the both end sides.

In the embodiment, a part of toner (not shown) supplied through the toner supply opening 14 moves over the wall portion 101*a* and flows out the toner guide 101, and a remaining portion of toner is delivered with the spiral 26 (FIG. 4) toward the both end sides. Toner is discharged outside the toner guide 101 while being transported, so that an amount of toner delivered decreases toward the both end sides. As described above, the wall portion 101*a* has a length in a vertical direction decreasing toward the both end sides. Accordingly, toner is discharged outside the toner guide 101 more easily toward the both end sides. As a result, an amount of toner becomes uniform along the longitudinal direction of the developer storage section 19 (FIG. 13).

Fifth Embodiment

Figure 20:
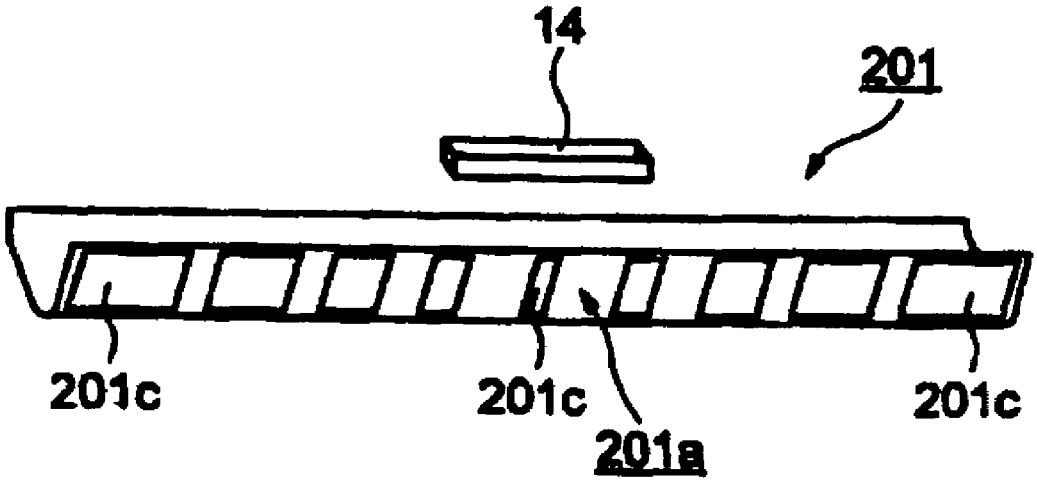
FIG. 20 is a schematic perspective view showing a toner guide according to a fifth embodiment of the present invention.

A fifth embodiment of the present invention will be explained next. FIG. 20 is a schematic perspective view showing a toner guide 201 according to the fifth embodiment of the present invention.

As shown in FIG. 20, the toner guide 201 includes a wall portion 201*a* with a slit 201*c* having a width smallest adjacent to the toner supply opening 14 and increasing away from the toner supply opening 14. That is, the slit 201*c* is formed to become narrow at a center portion of the wall portion 201*a* and wide at both end sides thereof.

In the embodiment, a part of toner (not shown) supplied through the toner supply opening 14 flows out the toner guide 201 through the slit 201*c*, and a remaining portion of toner is delivered with the spiral 26 (FIG. 4) toward the both end sides. Toner is discharged outside the toner guide 201 while being transported, so that an amount of toner delivered decreases toward the both end sides. As described above, the slit 201*c* has a width increasing toward the both end sides. Accordingly, toner is discharged outside the toner guide 201 more easily toward the both end sides. As a result, an amount of toner becomes uniform along the longitudinal direction of the developer storage section 19 (FIG. 13).

Sixth Embodiment

Figure 21:
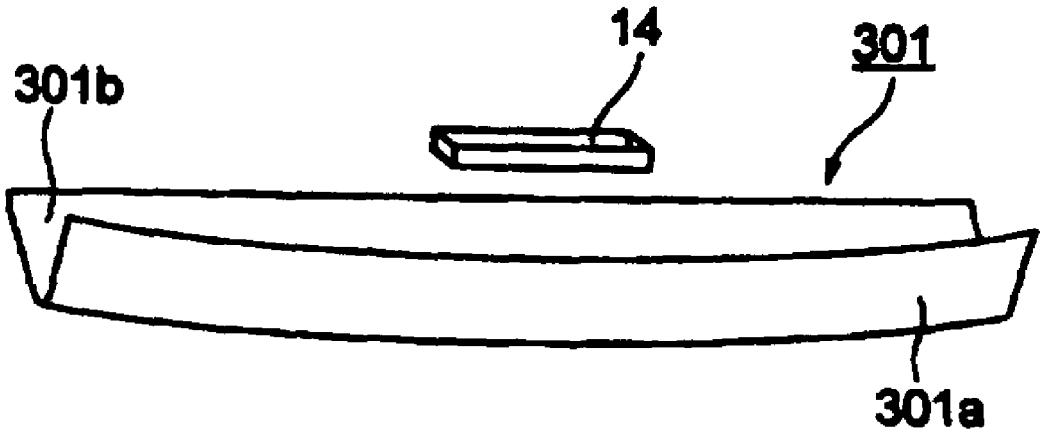
FIG. 21 is a schematic perspective view showing a toner guide according to a sixth embodiment of the present invention.
Figure 22:
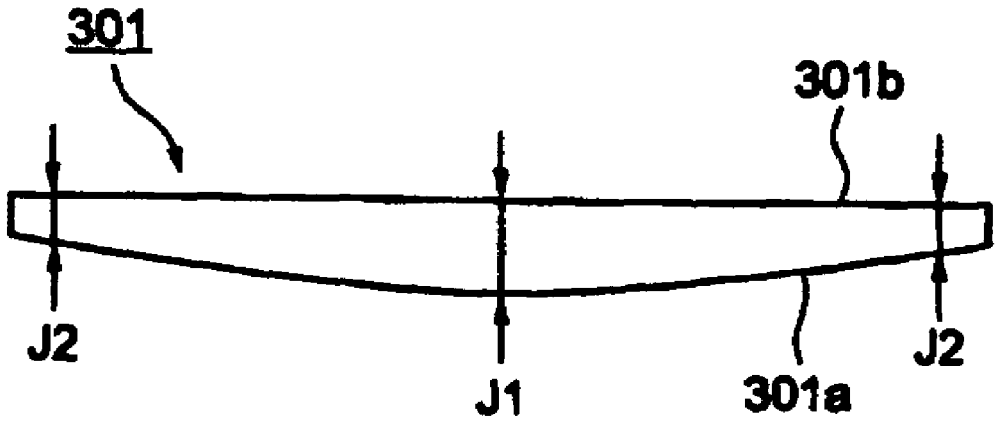
FIG. 22 is a schematic plan view showing the toner guide according to the sixth embodiment of the present invention.

A sixth embodiment of the present invention will be explained next. FIG. 21 is a schematic perspective view showing a toner guide 301 according to the sixth embodiment of the present invention. FIG. 22 is a schematic plan view showing the toner guide 301 according to the sixth embodiment of the present invention.

As shown in FIGS. 21 and 22, the toner guide 301 includes a wall portion 301*a* having a curved shape and a wall portion 301*b* having a flat shape. Accordingly, the toner guide 301 has a width largest adjacent to the toner supply opening 14 and decreasing away from the toner supply opening 14. That is, the toner guide 301 is formed to have a wide width J1 at a center portion of the wall portion 301*a* for easily holding toner and a narrow width J2 at both end sides thereof where it is difficult to hold a large amount of toner.

In the embodiment, a part of toner (not shown) supplied through the toner supply opening 14 moves over the wall portion 301*a* and flows out the toner guide 301, and a remaining portion of toner is delivered with the spiral 26 (FIG. 4) toward the both end sides. Toner is discharged outside the toner guide 301 while being transported, so that an amount of toner delivered decreases toward the both end sides. As described above, the toner guide 301 has the narrow width J2 at the both end sides. Accordingly, toner is discharged outside the toner guide 301 more easily toward the both end sides. As a result, an amount of toner becomes uniform along the longitudinal direction of the developer storage section 19 (FIG. 13).

In the embodiments described above, the image forming apparatus is the printer as an example. The present invention is applicable to a copier, a facsimile, and a multi-function device.

The disclosure of Japanese Patent Application No. 2005-289080, filed on Sep. 30, 2005, is incorporated in the application.

While the invention has been explained with reference to the specific embodiments of the invention, the explanation is illustrative and the invention is limited only by the appended claims.

What is claimed is:

1. A developing device comprising:

a developer container having a developer supply opening;

a developer storage section for receiving developer from the developer container through the developer supply opening;

a developer guide member disposed below the developer supply opening and above the developer storage section along a longitudinal direction of the developer container so that the developer is accumulated in the developer guide member, said developer guide member including a wall portion having a shape so that the developer flows out the developer guide member and is supplied to the developer storage section in a substantially uniform amount along the longitudinal direction; and a developer delivery member disposed in the developer guide member for delivering the developer in the longitudinal direction.

2. The developing device according to claim 1, wherein said wall portion has an upper edge having a height largest adjacent to the developer supply opening and decreasing away from the developer supply opening.

3. The developing device according to claim 1, wherein said developer guide member is situated at a position higher than a level of the developer when the developer inside the developer storage section is at a low level.

4. The developing device according to claim 1, wherein said developer container has the developer supply opening at a center portion thereof in the longitudinal direction, said wall portion having an upper edge having a height largest at the center portion and decreasing toward both end side portions of the developer container.

5. The developing device according to claim 4, further comprising a developer supporting member disposed in the developer storage section and a developer supply member disposed in the developer storage section for supplying the developer to the developer supporting member, said developer guide member being situated above the developer supporting member and the developer supply member.

6. The developing device according to claim 5, wherein said wall portion is situated at an upper position on an upstream side in a rotational direction of the developer supply member with respect to a facing position between the developer supporting member and the developer supply member.

7. The developing device according to claim 5, wherein said wall portion is situated away from a housing of the developing device with a space in between, said space being situated at an upper position on an upstream side in a rotational direction of the developer supply member with respect to a facing position between the developer supporting member and the developer supply member.

8. The developing device according to claim 1, wherein said developer container has the developer supply opening at one end side portion thereof in the longitudinal direction, said wall portion having an upper edge having a height largest at the one end side portion and decreasing toward the other end side portion of the developer container.

9. The developing device according to claim 1, wherein said developer container has the developer supply opening at both end side portions thereof in the longitudinal direction, said wall portion having an upper edge having a height largest at the both end side portions and decreasing toward a center portion of the developer container.

10. The developing device according to claim 1, wherein said wall portion has an upper edge having a curved shape.

11. The developing device according to claim 1, wherein said wall portion has an upper edge having a shape connected with a straight line.

12. The developing device according to claim 1, wherein said wall portion has an upper edge having a step shape.

13. The developing device according to claim 1, further comprising a developer supply member for supplying the developer to a developer supporting member, said developer guide member being situated above a contact point between the developer supply member and the developer supporting member.

14. An image forming apparatus comprising the developing device according to claim 1.

15. The developing device according to claim 1, further comprising a developer supporting member disposed in the developer storage section and a developer supply member disposed in the developer storage section for supplying the developer to the developer supporting member, said developer guide member being situated above the developer supporting member and the developer supply member.

16. The developing device according to claim 15, wherein said wall portion is situated at an upper position on an upstream side in a rotational direction of the developer supply member with respect to a facing position between the developer supporting member and the developer supply member.

17. The developing device according to claim 15, wherein said wall portion is situated away from a housing of the developing device with a space in between, said space being situated at an upper position on an upstream side in a rotational direction of the developer supply member with respect to a facing position between the developer supporting member and the developer supply member.

18. The developing device according to claim 1, wherein said developer guide member is formed in a U-character shape with an upper opening.

* * * * *